US006326877B1

(12) United States Patent
Hay et al.

(10) Patent No.: US 6,326,877 B1
(45) Date of Patent: Dec. 4, 2001

(54) TRANSFORMER COIL SUPPORT STRUCTURE

(75) Inventors: Noah D. Hay, Wingate; Gary D. King, Matthews, both of NC (US)

(73) Assignee: Square D Company, Palatine, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/334,230

(22) Filed: Jun. 16, 1999

(51) Int. Cl.[7] ..... H01F 27/30; H01F 30/12

(52) U.S. Cl. ..... 336/198; 336/208; 336/12; 336/5

(58) Field of Search ..... 336/198, 208, 336/205, 206, 209, 5, 12; 29/602.1, 606

(56) References Cited

U.S. PATENT DOCUMENTS

| | | | | |
|---|---|---|---|---|
| 3,559,134 | * | 1/1971 | Daley | 336/205 |
| 3,947,795 | * | 3/1976 | Donnelly et al. | 336/198 |
| 4,219,791 | * | 8/1980 | Moore et al. | 336/58 |
| 4,250,479 | * | 2/1981 | Bausch et al. | 336/208 |
| 4,857,876 | * | 8/1989 | Costa | 336/165 |
| 4,857,878 | * | 8/1989 | Eng, Jr. et al. | 336/192 |
| 4,904,975 | * | 2/1990 | Medenbach | 336/192 |
| 5,396,210 | * | 3/1995 | Purohit et al. | 336/60 |
| 5,592,138 | * | 1/1997 | Tobben | 336/210 |

FOREIGN PATENT DOCUMENTS

| | | | | |
|---|---|---|---|---|
| 60-7114 | * | 1/1985 | (JP) | 336/198 |

OTHER PUBLICATIONS

Medium Voltage Transformers Selection Guide, Square D Company Mar. 1997, pp. 1–16.

Uni–Cast Coil Transformers, Square D Groupe Schneider, Mar. 1993, pp. 1–8.

* cited by examiner

*Primary Examiner*—Anh Mai

(57) ABSTRACT

A winding structure for a transformer has a first support having a central axis, and a second support also having a central axis. The second support is positioned having its central axis generally in-line with the central axis of the first support. The winding structure also has a winding which is wrapped around at least a portion of the first and second supports. The supports are tubular and are provided for at least supporting the winding. A method of making the transformer includes the steps of providing a mounting apparatus, and mounting a first support having a central on the mounting apparatus. The method also includes mounting a second support having a central axis on the mounting apparatus, wherein the second support is mounted on the mounting apparatus with its central axis mounted generally in-line with the central axis of the first support. In addition, the method includes winding a conductor around at least a portion of the first and second supports to form a winding.

18 Claims, 7 Drawing Sheets

TRANSFORMER COIL SUPPORT STRUCTURE

DESCRIPTION

1. Technical Field

The present invention relates generally to transformers and winding structures of transformers. More particularly, the present invention relates to a support arrangement used within the winding structures of transformers during and after the manufacture of transformers to, at least, maintain the integrity of the windings and the winding structures during and after the manufacturing process.

2. Background of the Invention

In the past, transformer winding structures have included a rigid coil or winding base, or support, which adds significant stiffness to the coil or winding during the manufacturing process. Without any support, the conductor winding can cause the overall winding structure to collapse into the interior portion or hollow core (leg) region of the transformer winding structure. The support assists in maintaining integrity of the winding(s) during and after the manufacturing process, eases assembly of the transformers and the winding(s), and provides added short circuit strength during fault conditions in view of the added support and strength of the windings of the transformer. In the past, the rigid winding base or support has been a single elongated tube-like structure which extended from the top interior portion of the transformer winding structures to the bottom of the interior portion of the transformer winding structures. These elongated supports are typically expensive. For example, using three elongated supports for a three-phase transformer (each of the three winding structures of a three phase (leg) transformer would use one elongated support), could add over $1,000 of cost to such a transformer.

The present invention is provided to solve these and other problems.

SUMMARY OF THE INVENTION

The present invention relates to a winding structure for a transformer. The winding structure has a first support having a central axis, and a second support also having a central axis. The second support is positioned having its central axis generally in-line with the central axis of the first support. The winding structure also has a winding which is wrapped around at least a portion of the first and second supports. The supports are provided for at least supporting the winding. The present invention also relates to a method of making a transformer comprising the steps of providing a mounting apparatus, and mounting a first support having a central axis on the mounting apparatus. The method also includes mounting a second support having a central axis on the mounting apparatus, wherein the second support is mounted on the mounting apparatus with its central axis mounted generally in-line with the central axis of the first support. In addition, the method includes winding a conductor around at least a portion of the first and second supports to form a winding.

DETAILED DESCRIPTION

Figure 1:
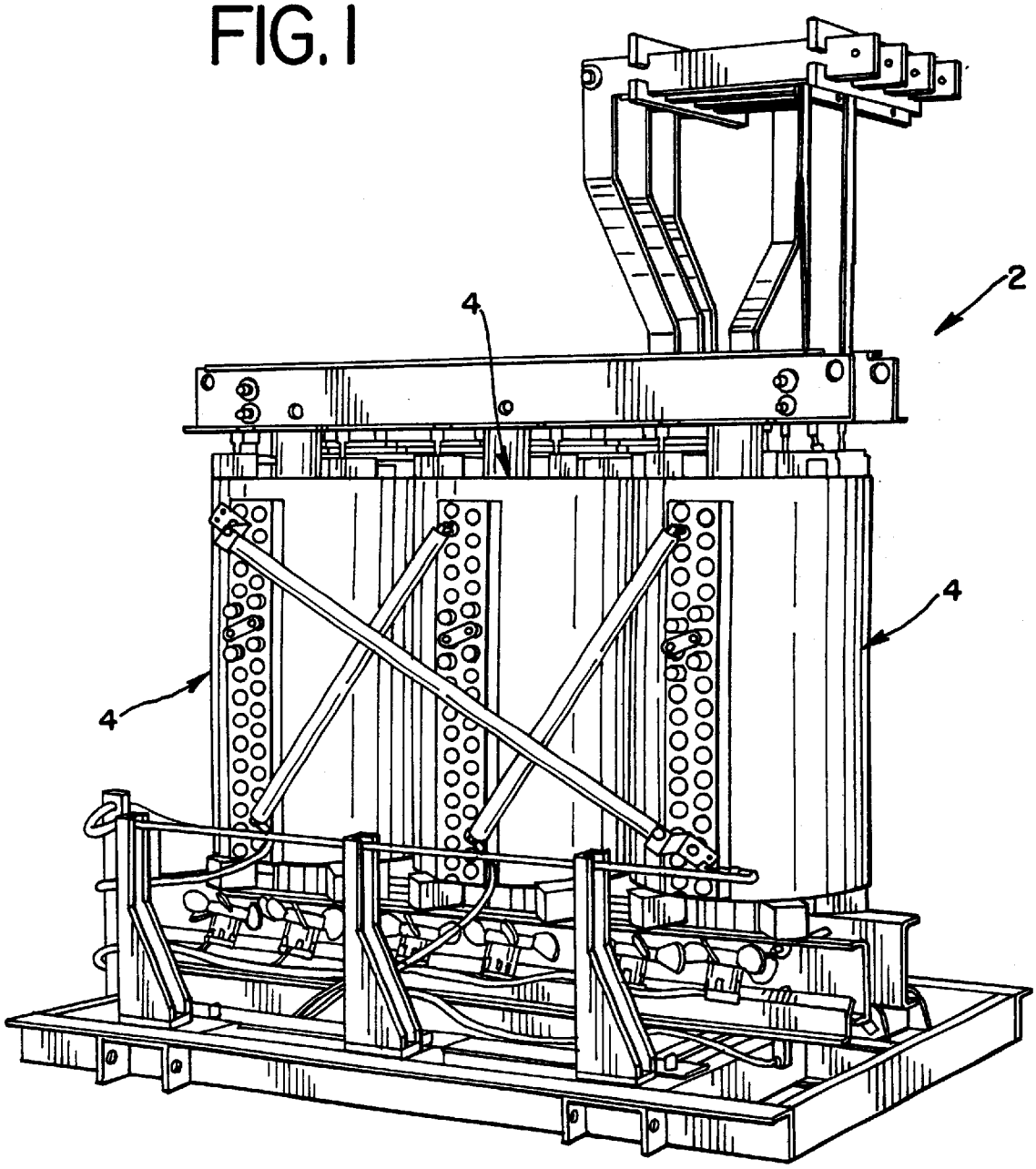
FIG. 1 is a perspective view of a cast coil (winding structure) transformer of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

With reference to FIGS. 1, 4, 5, and 6, these Figures show various views of a cast coil transformer 2. This transformer 2 has three winding structures 4, and each winding structure 4 has a primary winding (coil or conductor) 6, and at least one secondary winding (coil or conductor) 8. The winding structures 4 can have a length of insulated wire (winding conductor) formed into plurality of adjacent turns defining a layer. As is well known, many layers of adjacent turns separated by insulation typically form the coils (winding). Other conductors can be used, such as a sheet or strip of metal for the windings 6, 8. As used herein, the term conductor can be defined as comprising a wire conductor, a sheet or strip of metal type conductor, or such other conductor which can be used to create a winding for a transformer. In addition to the above conventional terminology, a winding structure can include common elements such as a winding, insulators, spacers for the conductor of the winding, and other elements.

Figure 4:
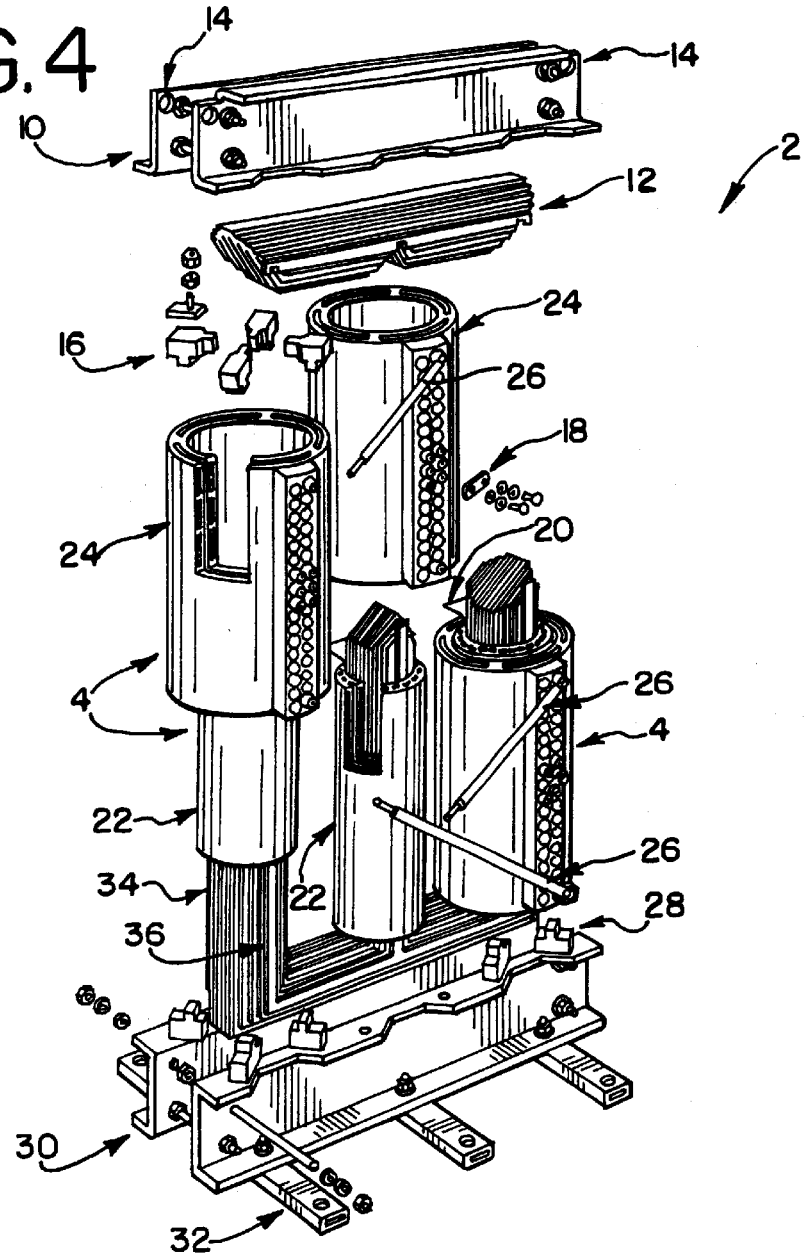
FIG. 4 is an exploded perspective view of the transformer of FIG. 1.

With particular focus on FIG. 4, an upper core clamp 10 is provided to firmly secure the upper core assembly including the upper core yoke 12 in position and to increase structural integrity. The upper core yoke 12 completes a core assembly and maintains position of cores within the coils. The upper core clamp 10 includes lifting holes 14 for allowing connection to a crane or other lifting devices to lift and move the overall transformer 2.. Upper support blocks 16 are provided for axially supporting the coils of the winding structures 4. High voltage tap links 18 are also provided for tapping the coils, above and below normal, as one of ordinary skill in the art would understand. Low voltage (LV) leads 20 are extended from the LV (interior) coils 22 for connection to LV buswork. High voltage (HV) connections 26 are provided for connecting the three phases of the primary transformer 2, and can be made from insulated cables supported by plastic tubes. Lower support blocks 28 are also provided for axially supporting the coils 24, 26 of the winding structures 4 and maintaining spacing between the LV and HV coils 24, 26, as shown in a molded epoxy design. A lower core clamp 30 is also provided for firmly securing the lower core assembly in position and for increasing structural integrity. Mounting feet 32 are provided for supporting the overall transformer structure and allows for a variety of standard or optional enclosures (not shown). A cruciform core 34 is assembled from core laminations and positioned as shown, as one of ordinary skill in the art would understand. The laminations are fabricated from high grade, grain oriented silicon steel. Core straps 36 tightly secure the core laminations to ensure structural and magnetic integrity.

Figure 5:
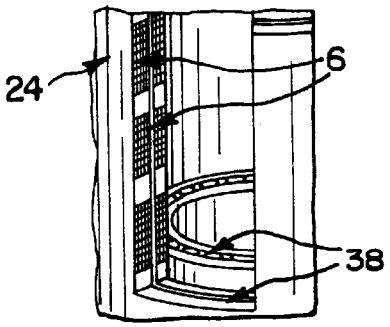
FIG. 5 is a cut away perspective view of one winding structure of a High Voltage (HV) transformer version of the transformer of FIG. 4.
Figure 6:
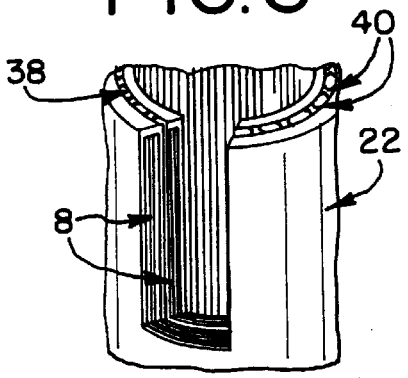
FIG. 6 is a cut away perspective view of one winding structure of a Low Voltage (LV) transformer version of the transformer of FIG. 4.

Referring to FIGS. 5 and 6, primary conductors 6 are wound from aluminum, copper, or other conductor, and are vacuum impregnated and completely encapsulated in a solid dielectric. Air ducts 38 are provided for allowing the free-flow of air between the coil windings. Spacers 40 are used to create the air ducts 38. Secondary conductors 8 are wound from aluminum, copper, or other conductor sheets, and layered with pre-impregnated epoxy material. The coils are vacuum pressure impregnated, baked, and then sealed.

Figure 3:
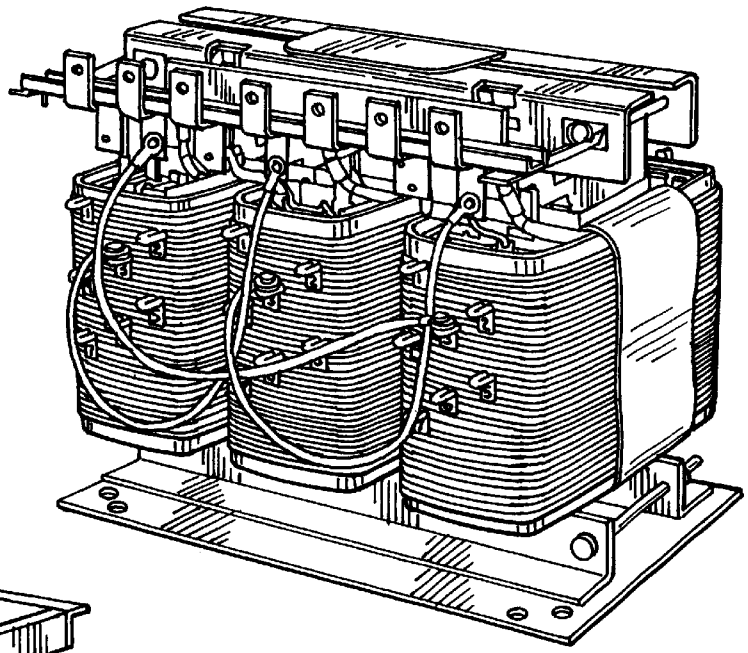
FIG. 3 is a three phase transformer of the present invention.
Figure 2:
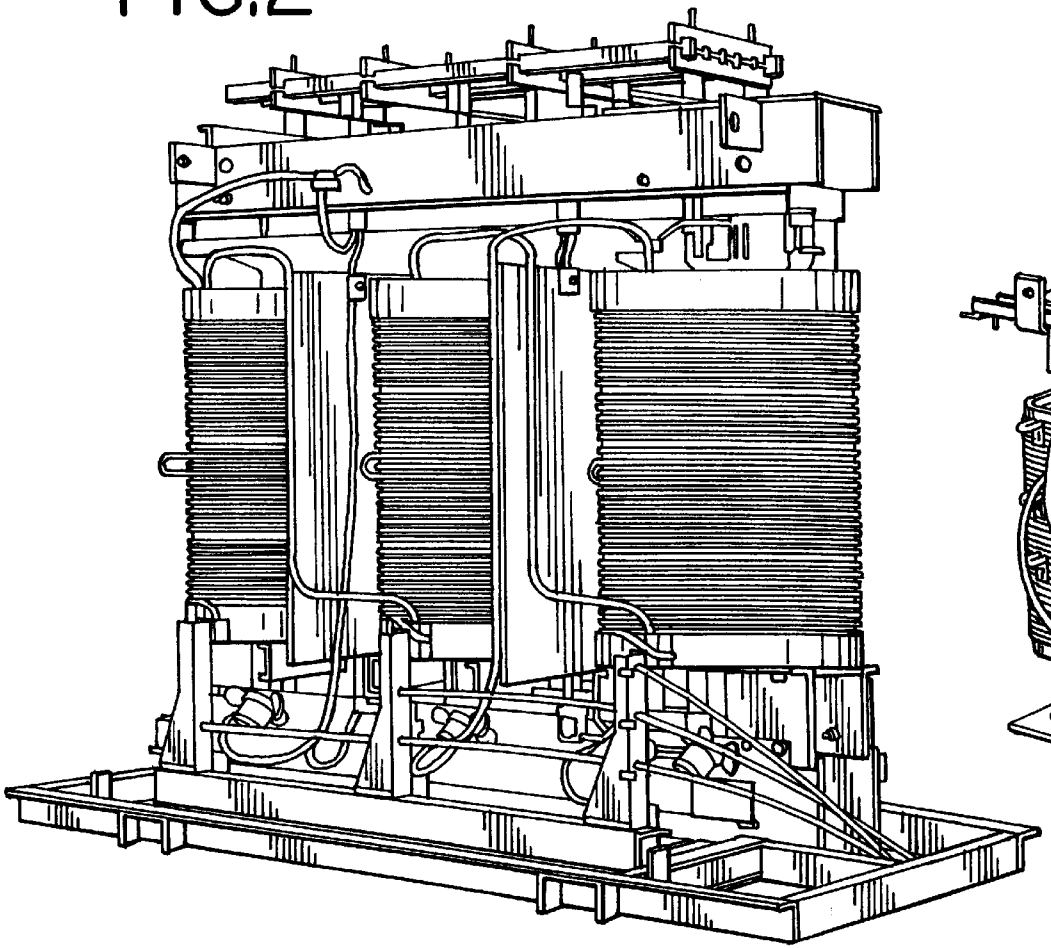
FIG. 2 is a perspective view of an open-ventilated, medium voltage, disk-wound dry type transformer of the present invention.

FIGS. 2 and 3 show additional types of transformers. In particular, FIG. 2 shows a open-ventilated, medium voltage, disk-wound dry type transformer, and FIG. 3 shows a three-phase transformer of the present invention. The present invention can be applied to the above and other types of transformers.

Figure 7:
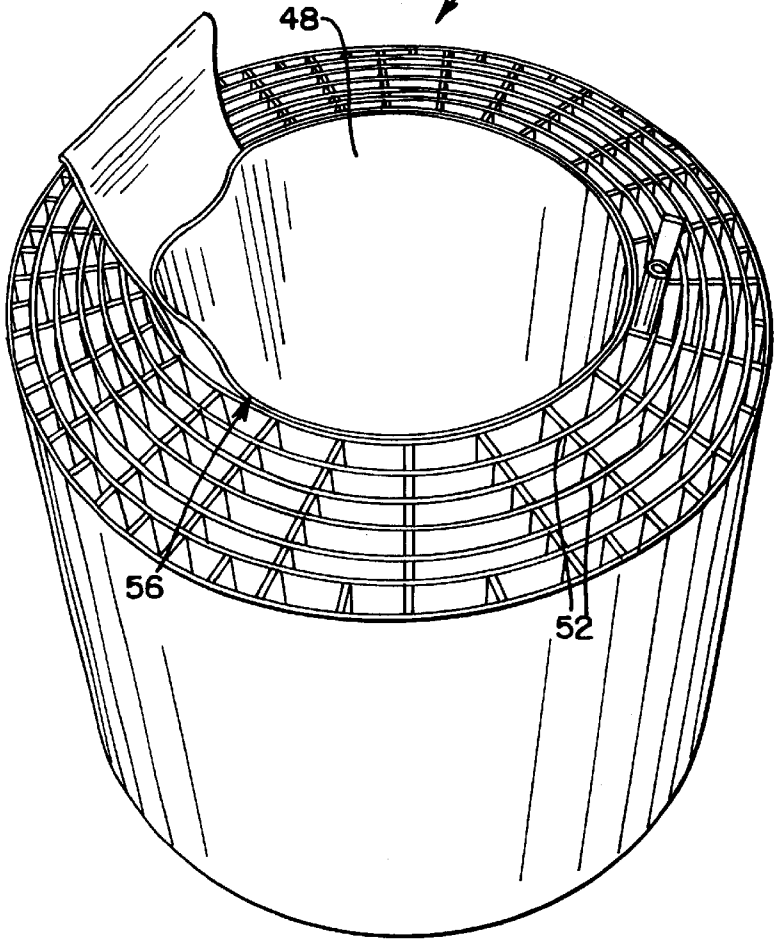
FIG. 7 is a top perspective view of a cylindrical winding structure without any supports, of a transformer.
Figure 9:
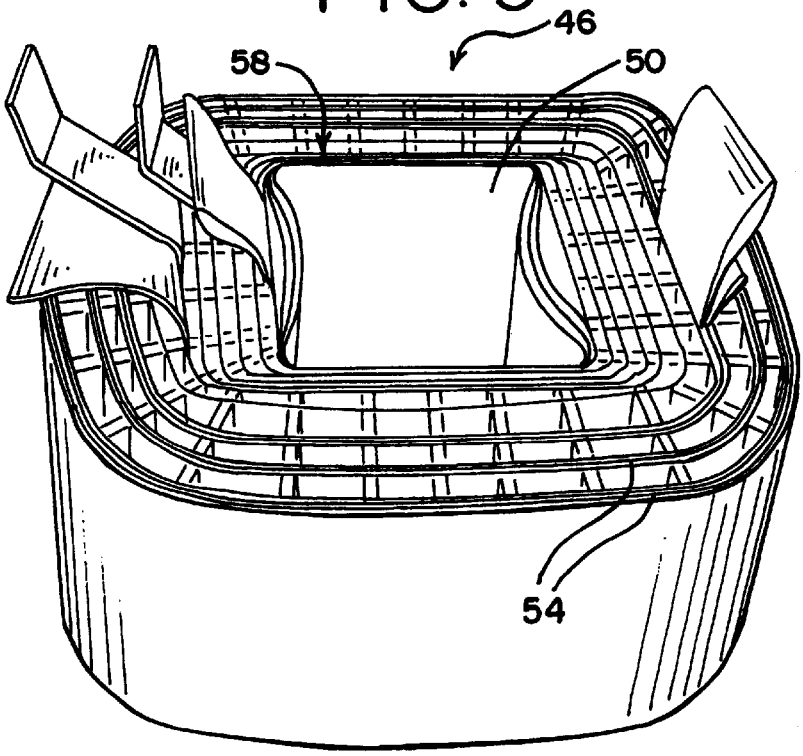
FIG. 9 is a top perspective view of an oval winding structure without any supports, of a transformer.

FIGS. 7 and 9 depict cylindrical (circular center) and oval (square center) winding structures 44, 46, respectively. These winding structures 44, 46 were manufactured without any supports (rigid coil/winding base) adjacent the interior portion or hollow core (leg) region 48, 50 of these winding structures 44, 46. As can be seen within these Figures, without any support, the conductor winding 52, 54 and other stresses, have caused these winding structures 44, 46, and in particular the interior insulator 56, 58 to collapse into the interior portion 48, 50 or become warped out of shape.

Figure 8:
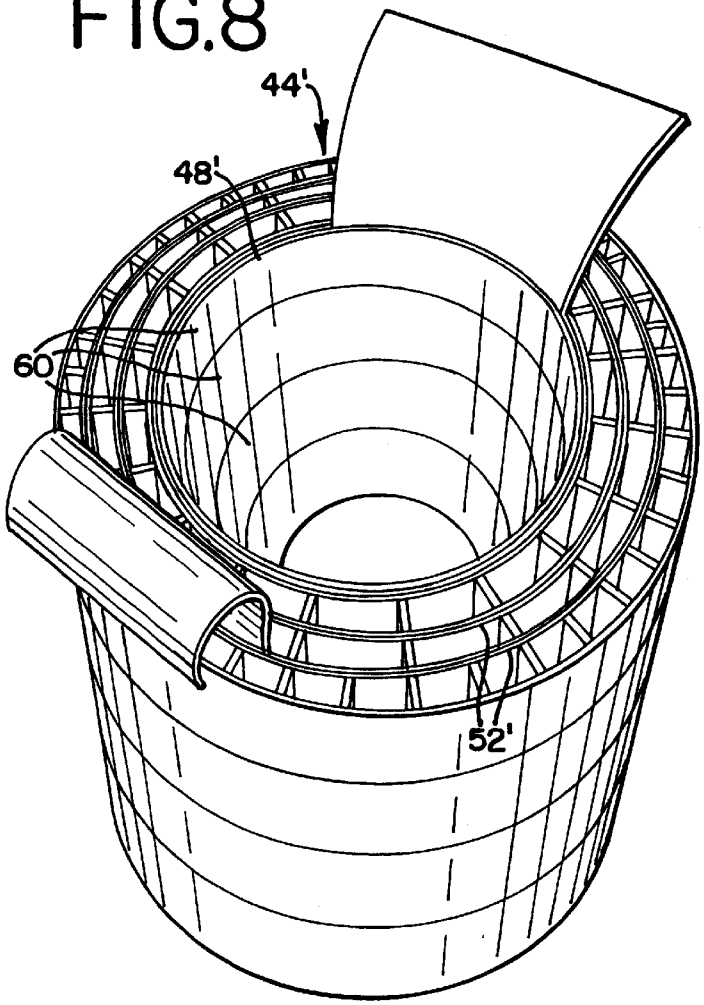
FIG. 8 is a top perspective view of a cylindrical winding structure with supports, of a transformer of the present invention.
Figure 10:
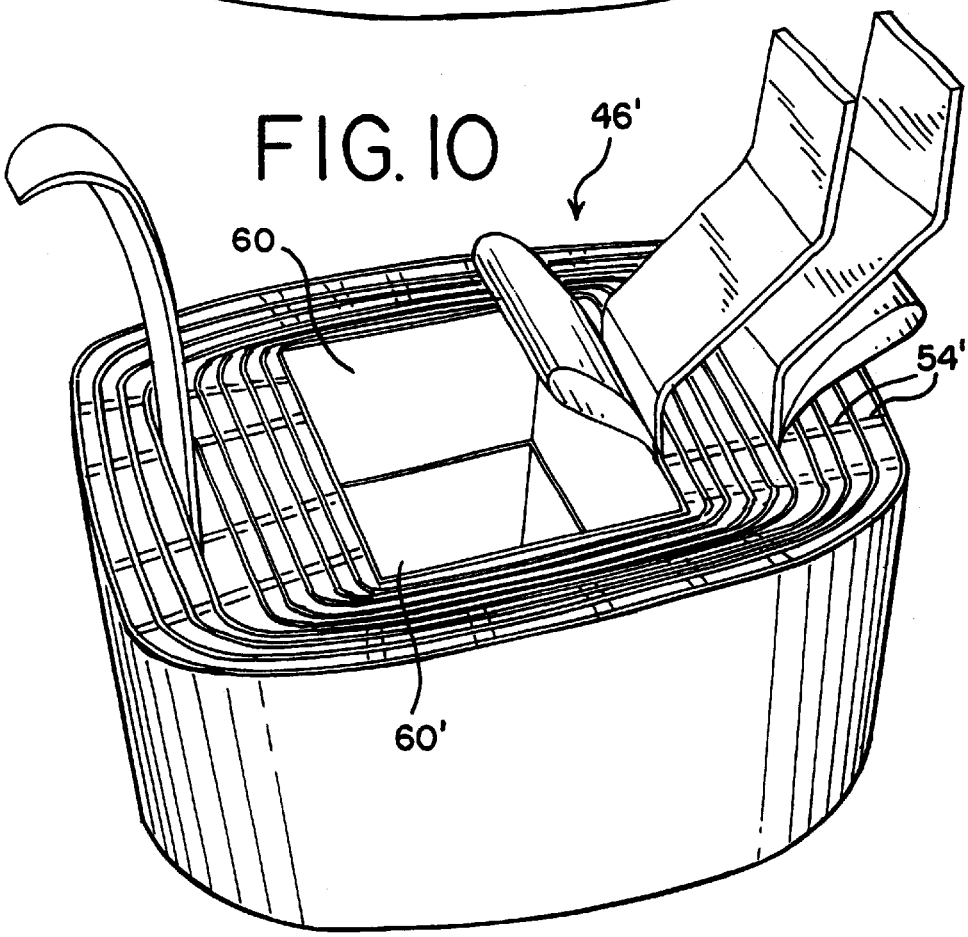
FIG. 10 is a top perspective view of an oval winding structure with supports, of a transformer of the present invention.

FIGS. 8 and 10 depict the same type of transformer winding structures 44', 46' of FIGS. 7 and 9, respectively, except that several supports 60 have been used in the manufacturing process of each winding structure 44', 46'. As can be seen in these FIGS. 8 and 10, the supports 60 are positioned adjacent the interior portion 48', 50' of the winding structure 44', 46'. Contrary to the winding structures 44, 46 in FIGS. 7 and 9, the supports 60 that exist within these winding structures 44', 46' have maintained the integrity of the windings 52', 54' and the winding structure 44', 46' during and after the manufacturing process, have eased assembly of the windings 52', 54' and the winding structure 44', 46', and will provide added short circuit strength during fault conditions in view of the added support and strength of the windings 52', 54' and winding structures 44', 46' of the transformer.

Figure 11:
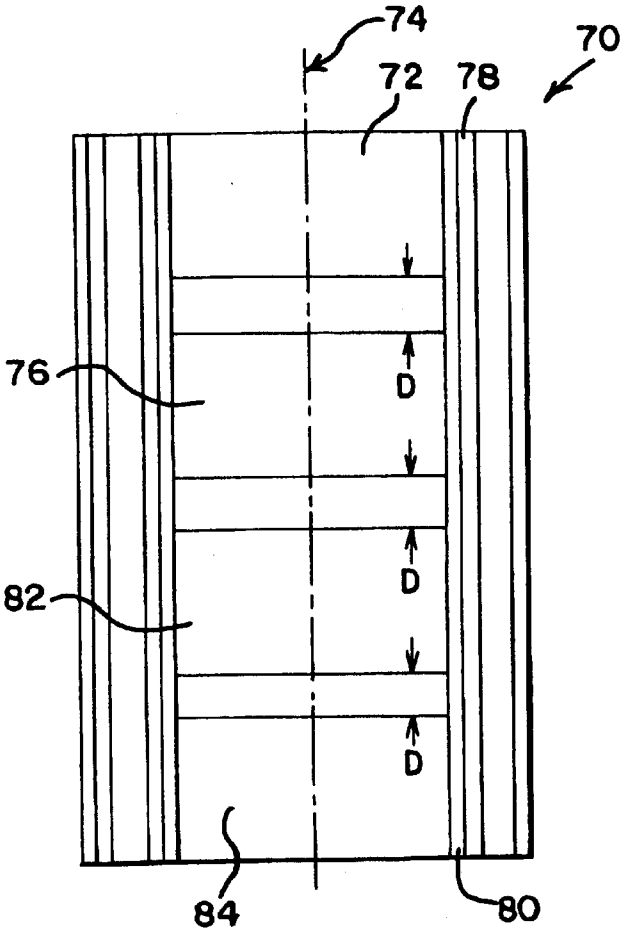
FIG. 11 is a cross-sectional diagram of one embodiment of a winding structure of a transformer of the present invention.

With reference to FIG. 11, a cross-section of a winding structure 70 is shown for use in a transformer (see FIGS. 1 through 6). The winding structure 70 comprises a series of identically shaped tubular supports 72, 76, 82, and 84, each having a central axis 74. The winding structure 70 has the second support 76 positioned inline with the first suppport 72 wherein the second suppport 76 has its central axis 74 aligned with the central axis 74 of the first suppport 72. The winding structure 70 further has a winding 78 wrapped around at least a portion of the first and second supports 72, 76. The supports 72, 76 are provided for supporting the winding 78. As mentioned above, the winding 78 (see FIGS. 4, 5, and 6) can be made of a coil having a length of wire. As can be seen from FIGS. 4–8, the first and second supports 72, 76 can each have a hollow cylindrical shape. Alternatively, as can be seen from FIGS. 9 and 10, the first and second supports 72, 76 can each have a hollow rectangular shape.

The winding structure also has an insulator 80 positioned between the first support 72 and the winding 78, and between the second support 76 and the winding 78. The winding structure 70 can also have a third support 82 with a central axis 74. The third support 82 is also positioned having its central axis 74 aligned with the central axis 74 of the first and second supports 72, 76. The winding 78 is also wound around at least a portion of the third support 82. Additional supports, such as fourth support 84 can be used within the winding structure 70. The preferred material for the supports is polyester glass. However, other insulating materials or combination of laminated materials may be used.

In the winding structure 70 shown in FIG. 11, the first support 72 is spaced apart from the second support 76 by a distance D. Likewise, the second support 76 is spaced apart from the third support 82 by a distance D. Likewise, the third support 82 is spaced apart from the fourth support 84 by a distance D. However, the distance D between the supports can vary. Thus, the distance between two supports can be different from the distance between two other supports. In addition, the distance between two supports can be different from one of the two supports and another support.

Figure 12:
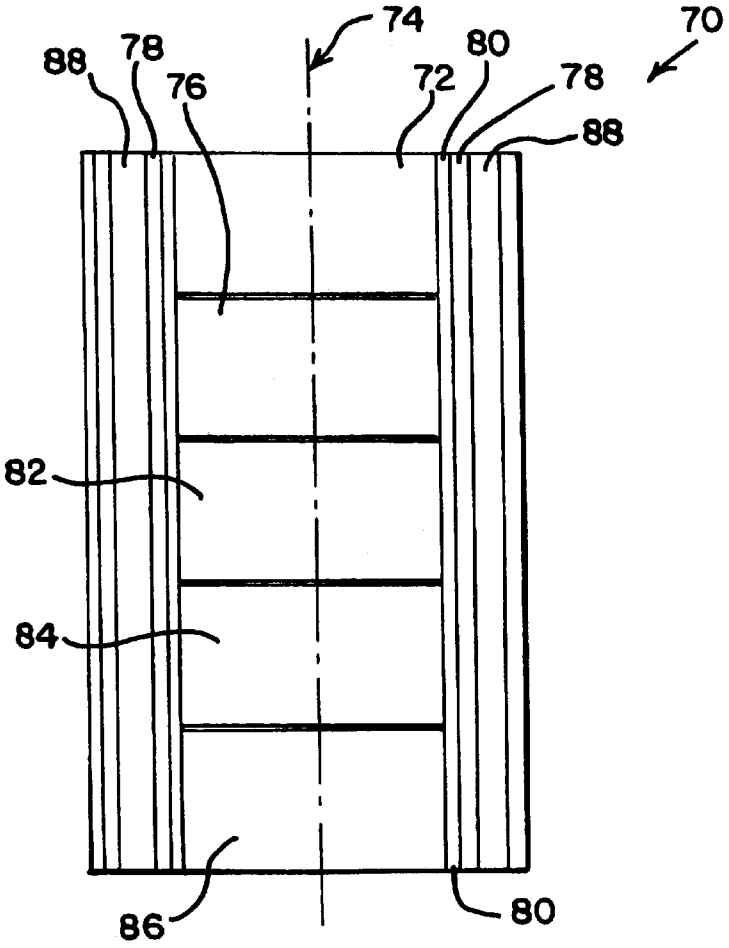
FIG. 12 is a cross-sectional diagram of another embodiment of a winding structure of a transformer of the present invention.

In the winding structure 70 shown in FIG. 12, the first support 72 is positioned adjacent the second support 76. Likewise, the second support 76 is positioned adjacent the third support 82. Likewise, the third support 82 is positioned adjacent the fourth support 84. Likewise, the fourth support 84 is positioned adjacent a fifth support 86.

With reference to FIGS. 11 ands 12, in an alternative embodiment, the present invention is a transformer (see FIGS. 1–10) having at least one winding structure 70. The winding structure 70 has a plurality of identically shaped supports 72, 76, 82, 84, 86, each having a central axis 74. The supports 72, 76, 82, 84, 86 are aligned along their central axis 74. The winding structure also has a winding 78 wrapped around at least a portion of each of the supports 72, 76, 82, 84, 86. As in the previous embodiments, the supports 72, 76, 82, 84, 86 are provided for supporting the winding 78. Other features of the previous embodiments apply equally to the present embodiment.

The winding structures shown in FIGS. 11 and 12 also have an air duct or vent 88 (cylindrical in shape) which is open at the top and bottom, and through the length of the winding structure 70. The vent 88 is adjacent the winding 78. A second winding 90 can be wrapped around the first winding 78, spaced apart by spacers (not shown), to create the vent 88. An exterior casing 92 encircles the second winding 90, and can be applied according to the transformer principles described in relation to FIGS. 1, 4, 5, and 6.

Figure 13:
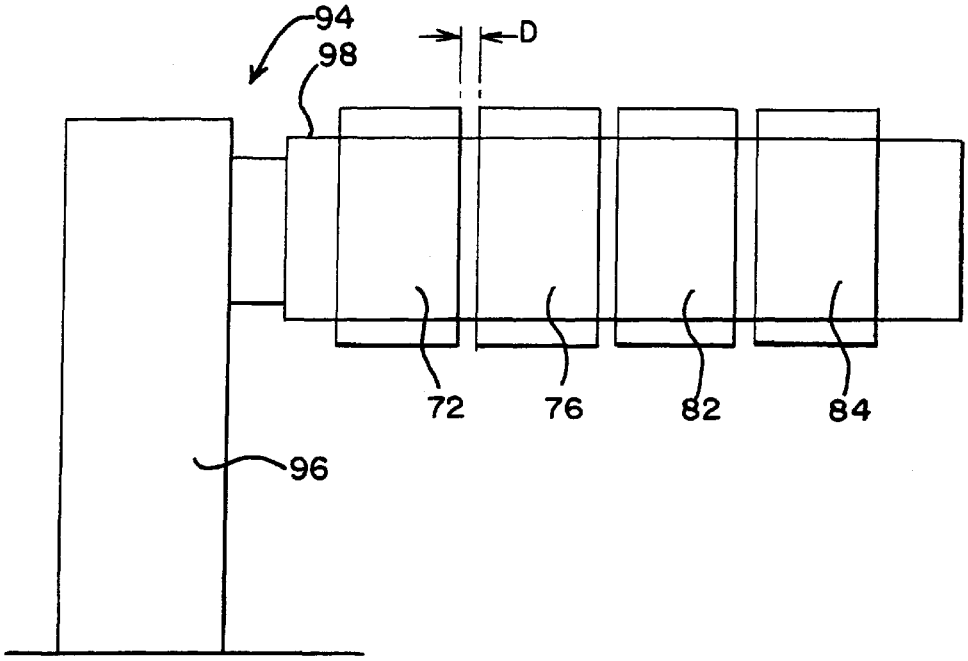
FIG. 13 is a side view of a mounting apparatus and supports for the manufacture of one embodiment of a winding structure of a transformer of the present invention.
Figure 14:
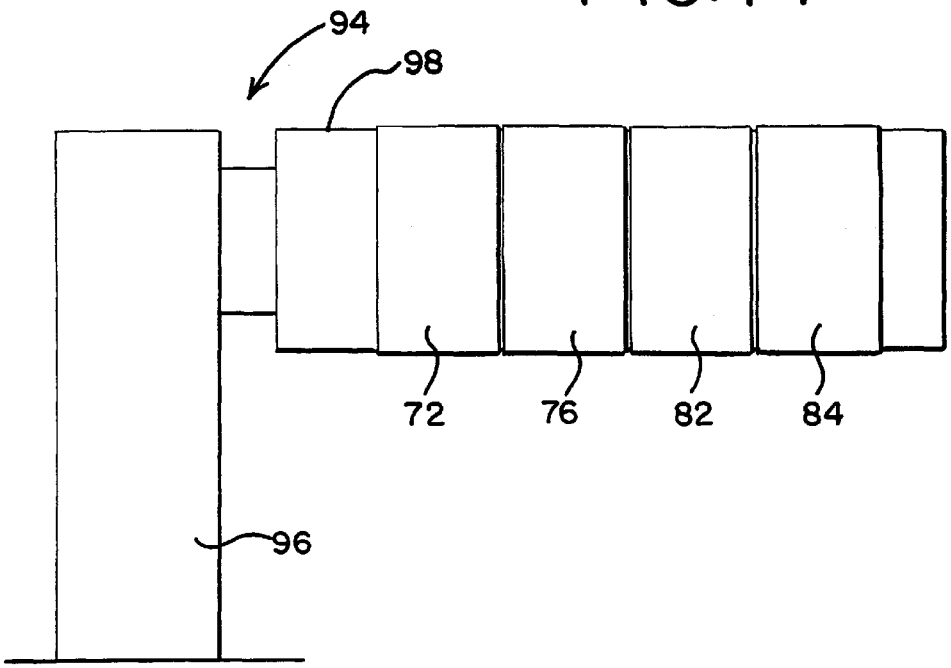
FIG. 14 is a side view of a mounting apparatus and supports for the manufacture of another embodiment of a winding structure of a transformer of the present invention.

With additional reference to FIGS. 13 and 14, the transformer winding structure of the present invention is constructed as follows. A mounting apparatus 94 is provided for mounting thereon the supports 72, 76, 82, 84. The mounting apparatus 94 has a base 96 and an expandable cylinder 98 for receiving the supports to be mounted thereon. FIG. 13 depicts the cylinder 98 in the non-expanded position, and FIG. 14 depicts the cylinder 98 in the expanded position. The supports 72, 76, 82, 84 are mounted on the cylinder 98 when the cylinder 98 is in the non-expanded position. The cylinder 98 is then expanded to hold the supports 72, 76, 82, 84 in place and to align the central axes 74 of the supports 72, 76, 82, 84. In mounting the supports 72, 76, 82, 84 on the cylinder 98, the supports 72, 76, 82, 84 can be mounted with a distance D between the supports 72, 76, 82, 84, with a varying distance between them, or with the supports 72, 76, 82, 84 adjacent one another. Other arrangements may exist depending on the winding structure 70 being manufactured.

An insulating form 80 can also be mounted over the supports 72, 76, 82, 84. A conductor is then wound around the supports 72, 76, 82, 84, if no insulator 80 is used, or around the insulator 80 if one is used, to form a winding 78. The mounting apparatus in FIGS. 13 and 14 uses a cylinder 98 for supports 72, 76, 82, 84 having a cylindrical shape. Other types of mounting apparatuses can be used for supports 72, 76, 82, 84 having rectangular shape. Other standard steps of manufacture are then performed, as one of ordinary skill in the art would know and understand.

While the specific embodiments have been illustrated and described, numerous modifications come to mind without significantly departing from the spirit of the invention and the scope of protection is only limited by the scope of the accompanying claims.

We claim:

1. A winding structure for a transformer, comprising:

a first tubular support having a central axis;

a second tubular support also having a central axis, wherein the second support is positioned having its central axis aligned with the central axis of the first support, wherein the first support is spaced apart from the second support by a fixed distance D, the first and second supports are positioned adjacent an interior portion of the winding structure to provide support for imploding forces; and a single, continuous winding wrapped around at least a portion of the first and second supports.

2. The winding structure of claim 1 wherein the winding comprises a coil having a length of wire.

3. The winding structure of claim 1 wherein the first and second supports each have a cylindrical shape.

4. The winding structure of claim 1 wherein the first and second supports each have a rectangular shape.

5. The winding structure of claim 1 further comprising:

an insulator positioned between the first support and the winding, and between the second support and the winding.

6. The winding structure of claim 1 further comprising:

a third tubular support having a central axis, wherein the third support is positioned having its central axis aligned with the central axis of the first and second supports, and wherein the winding is wound around at least a portion of the third support, wherein the first, second, and third supports for supporting the winding structure.

7. The winding structure of claim 1 wherein the first support is made of polyester glass.

8. A transformer having at least one winding structure comprising:

a plurality of identical shaped tubular supports each having a central axis, the plurality of supports being aligned along their central axis, wherein each of the plurality of supports is spaced apart from an adjacent support by a fixed distance D, the first and second supports are positioned adjacent an interior portion of the winding structure to provide support for imploding forces; and wherein a single, continuous winding is wound around a portion of each of the plurality of supports.

9. The transformer of claim 8 wherein the supports each have a cylindrical shape.

10. The transformer of claim 8 wherein the supports each have a rectangular shape.

11. The transformer of claim 8 further comprising:

an insulating form positioned between the supports and the winding.

12. The transformer of claim 8 wherein the supports are each made of polyester glass.

13. A method of making a winding structure for a transformer comprising the steps of:

providing a mounting apparatus;

mounting a first tubular support having a central axis on the mounting apparatus;

mounting a second tubular support having a central axis on the mounting apparatus, wherein the second support is mounted on the mounting apparatus with its central axis aligned with the central axis of the first support, wherein the first support is mounted spaced apart from the second support by a fixed distance D, wherein the first and second supports are positioned adjacent an interior portion of the winding structure to provide support for imploding forces; and winding a conductor around at least a portion of the first and second supports to form a single, continuous winding.

14. The method of claim 13 wherein the first and second supports each have a cylindrical shape.

15. The method of claim 13 wherein the first and second supports have a rectangular shape.

16. The method of claim 13 further comprising the step of:

positioning an insulating form over at least a portion of the first support and the second support, wherein the step of winding the conductor also includes winding the conductor around the insulating form.

17. The method of making a winding structure for the transformer of claim 13 further comprising:

mounting a third tubular support having a central axis on the mounting apparatus, wherein the third support is mounted on the mounting apparatus having its central axis aligned with the central axis of the first and second supports, and wherein the step of winding the conductor around at least a portion of the first and second supports also includes winding the conductor around at least a portion of the third support, to form the winding structure, wherein the first, second, and third supports for supporting the winding structure.

18. The method of claim 13 wherein the first support is made of polyester glass.

* * * * *